United States Patent [19]

Taylor

[11] 4,180,348

[45] Dec. 25, 1979

[54] SUBSURFACE IRRIGATION AND DRAINAGE SYSTEM

[76] Inventor: Richard H. Taylor, Rte. 1, Box 97, Como, N.C. 27818

[21] Appl. No.: 964,806

[22] Filed: Nov. 22, 1978

[51] Int. Cl.[2] ..... E02B 11/00; E02B 13/00

[52] U.S. Cl. ..... 405/39; 405/37; 405/43; 405/51

[58] Field of Search ..... 405/36, 37, 39, 40, 405/41, 43, 44, 51; 47/48.5, 79; 137/78; 239/63, 65

[56] References Cited

U.S. PATENT DOCUMENTS

| | | | |
|---|---|---|---|
| 585,103 | 6/1897 | Jamison | 405/39 |
| 1,343,871 | 6/1920 | Lewis | 405/37 |
| 1,758,941 | 5/1930 | Gibson | 405/37 |
| 3,408,818 | 11/1968 | Hemphill | 405/37 |
| 3,797,253 | 3/1974 | Rodieck | 405/37 |

FOREIGN PATENT DOCUMENTS

| | | | |
|---|---|---|---|
| 3815 | of 1912 | United Kingdom | 405/39 |

*Primary Examiner*—David H. Corbin

*Attorney, Agent, or Firm*—Mason, Fenwick & Lawrence

[57] ABSTRACT

An irrigation and drainage system for cultivated fields, croplands and the like for supplying and extracting water and similar liquids through a subsurface conduit network automatically responsive to the ground water table occurring above or below a predetermined subsurface reference level near the depth of the conduit network. A plurality of elongated subsurface perforated conduit lines are located throughout the field at a uniform depth below ground along one or more ground elevation contour line or lines for outflow or inflow of water through the conduit line perforations when the ground water level is respectively below and above the predetermined subsurface reference level. Distribution boxes having an adjustable weir and supply water and excess water connections are provided for the conduit lines at each elevation.

19 Claims, 7 Drawing Figures

16'
el. 8.0'
32
el. 8.5'
20b
10a
32
el. 8.0'
16'
17'
el. 9.0'
20b
17' el. 8.0'
18b
el. 8.0'
20c
20a
el. 9.0'
18a
32
el. 8.0'
20a
10c
el. 8.0'
10b 17
18
26
28b
28
27
30
28a
24
25
20
32
22
32
23

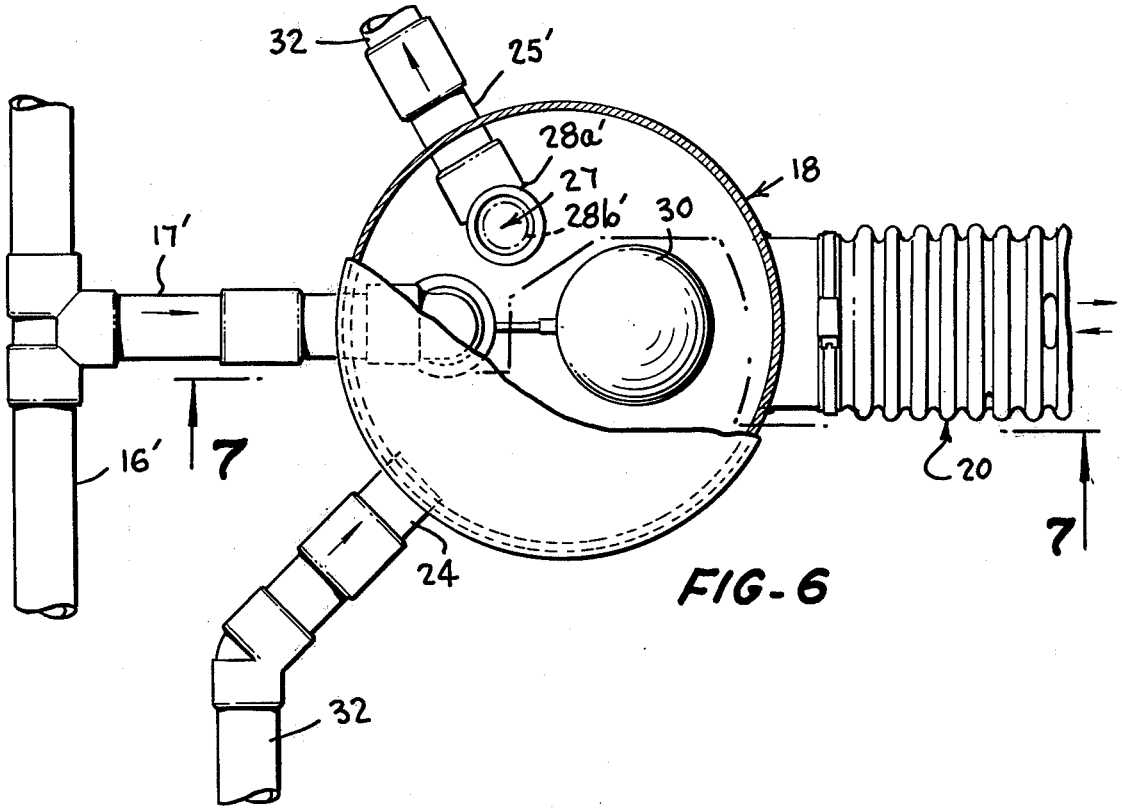
FIG-6
FIG-7
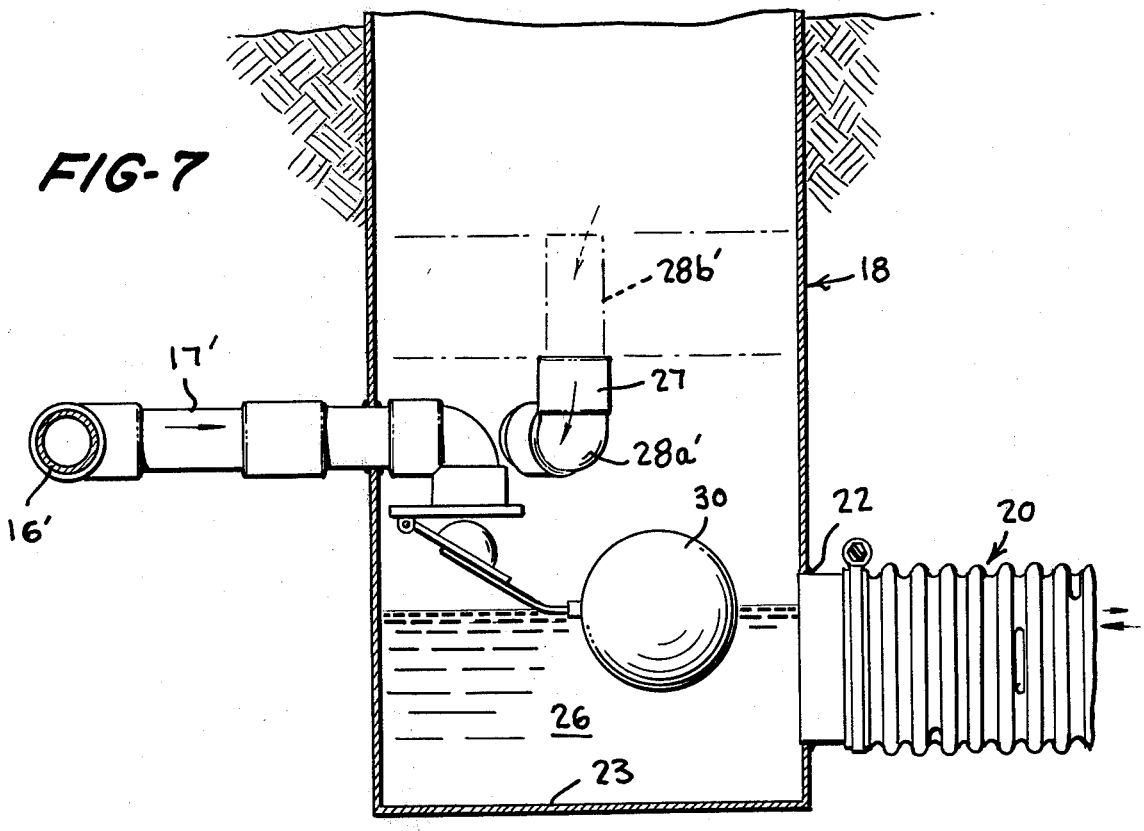

SUBSURFACE IRRIGATION AND DRAINAGE SYSTEM

BACKGROUND AND OBJECTS OF THE INVENTION

The present invention relates in general to combined irrigation and drainage systems for irrigating and draining cultivated fields or croplands as conditions require, and more particularly to subsurface irrigation and drainage systems for cultivated fields or croplands of varying topography wherein a network of distribution boxes to which water is supplied to predetermined levels from a head tank supply or receive water to or from a system of two-way subsurface conduits to maintain proper moisture conditions in the soil.

Heretofore, various systems have been proposed for irrigating large area cultivated fields or croplands, some of which have involved open irrigation or drainage ditches arranged in various arrays or networks through the cropland or cultivation area to be served, and which are supplied with water from a higher elevation source, but such systems are subject to extensive loss of water through evaporation, they constitute highly undesirable obstacles for cultivating machinery, and are difficult to achieve appropriate distribution of water throughout the cultivated land area where substantial variations in terrain occur. Surface irrigation systems involving networks of surface or above surface pipes and spraying nozzles have also been used, but such systems involve high operating expense and the use of complicated spraying equipment, and also are difficult to properly operate on highly irregular terrain.

Subsurface irrigation systems formed of networks of apertured pipes have also been proposed before, but have largely relied upon manually adjusted valves at various locations to regulate the supply of water to various branch sections or strings of subsurface irrigation pipe and have not provided for drainage of water from the soil into the pipe system to distribution boxes with excess water communication systems between the distribution boxes when the natural water table rises above the subsurface conduit or pipe system.

An object of the present invention is the provision of a novel irrigation and drainage system for croplands or cultivated land of various topography characteristics, wherein a subsurface system or network of submerged two-way slotted or apertured conduits are connected to a plurality of distribution boxes which are interconnected to provide for flow of supply water or excess water between the various distribution boxes, and having means for maintaining selected water levels in each of the distribution boxes in a manner causing supply of water to the cultivated field or cropland area when the natural water table is below selected levels and causing excess water to be drained from the soil through the conduits to the distribution boxes when the natural water table is above selected levels.

Another object of the present invention is the provision of a novel subsurface irrigation and drainage system for cultivated fields or croplands wherein water from a head tank or similar supply source is supplied through a plurality of interconnected distribution boxes having adjustable weirs therein and connected to two-way submerged perforated conduit strings or branches, together with supply water and excess water conduits interconnecting the distribution boxes and to a water collection or storage facility, providing automatically controlled supply of water for irrigating the cultivated field when the natural water table is below selected levels and for draining water from the field when the natural water table is above selected levels.

Another object of the present invention is the provision of a novel subsurface irrigation and drainage system as defined in the immediately preceding paragraph, wherein the distribution boxes are provided with float control valves for automatically regulating water supply from the head tank or source to maintain a selected water level in each distribution box, and wherein the weir means subdivides the distribution box to provide for excess water drainage to other distribution boxes into the system or to the collection and storage facility.

Other objects, advantages and capabilities of the present invention will become apparent from the following detailed description, taken in conjunction with the accompanying description described in preferred embodiments of the invention.

BRIEF DESCRIPTION OF THE FIGURES

FIG. 6 is a top plan view of another form of distribution box with interconnecting two-way branch conduit and excess water exit and supply conduits connected thereto; and FIG. 7 is a vertical section view of the distribution box of FIG. 6, taken along the line 7—7 of FIG. 6.

DETAILED DESCRIPTION OF PREFERRED EMBODIMENTS

Figure 1:
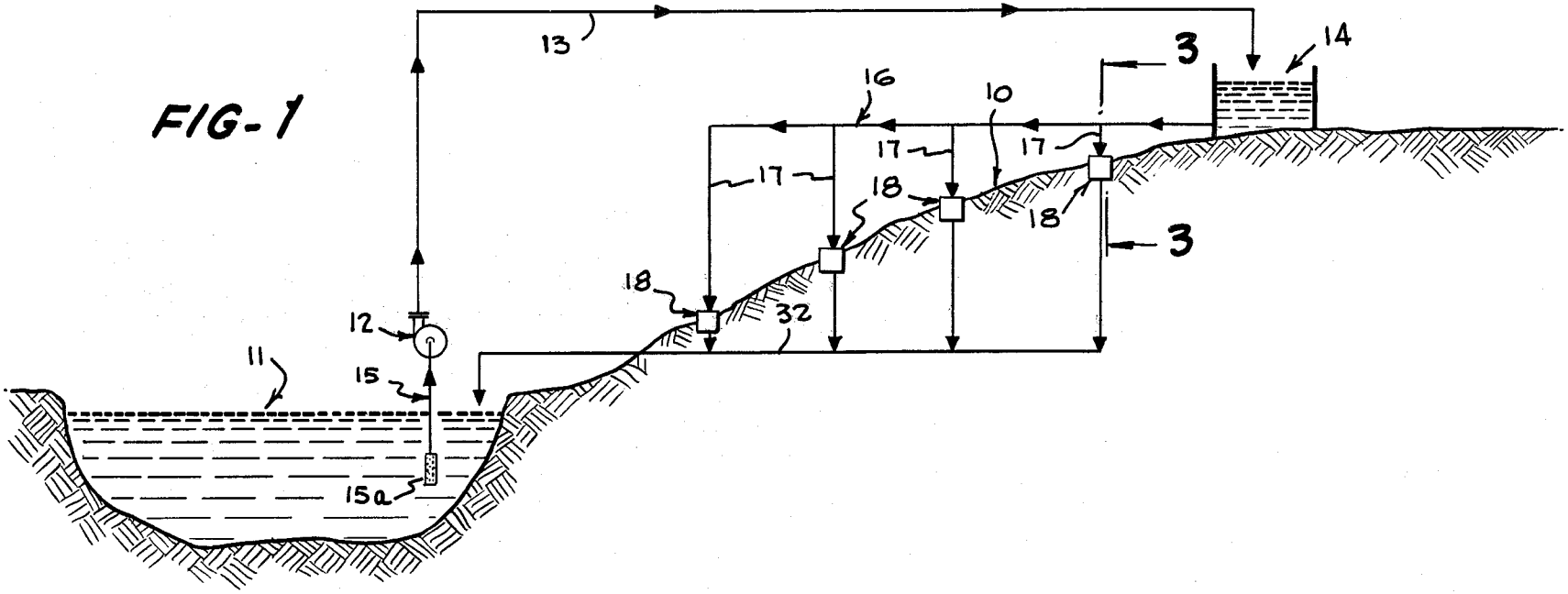
FIG. 1 is a schematic elevation diagram of a subsurface irrigation and drainage system embodying the present invention.
Figure 3:
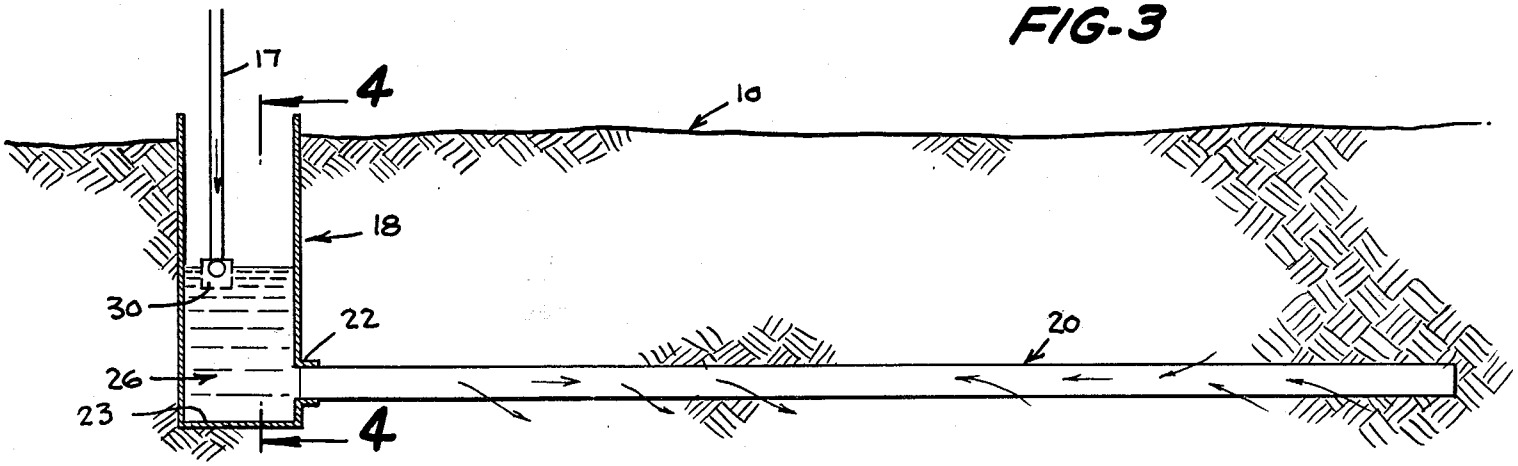
FIG. 3 is a fragmentary vertical section view through one of the distribution boxes and a branch two-way conduit section served thereby, taken along the line 3—3 of FIG. 1.
Figure 2:
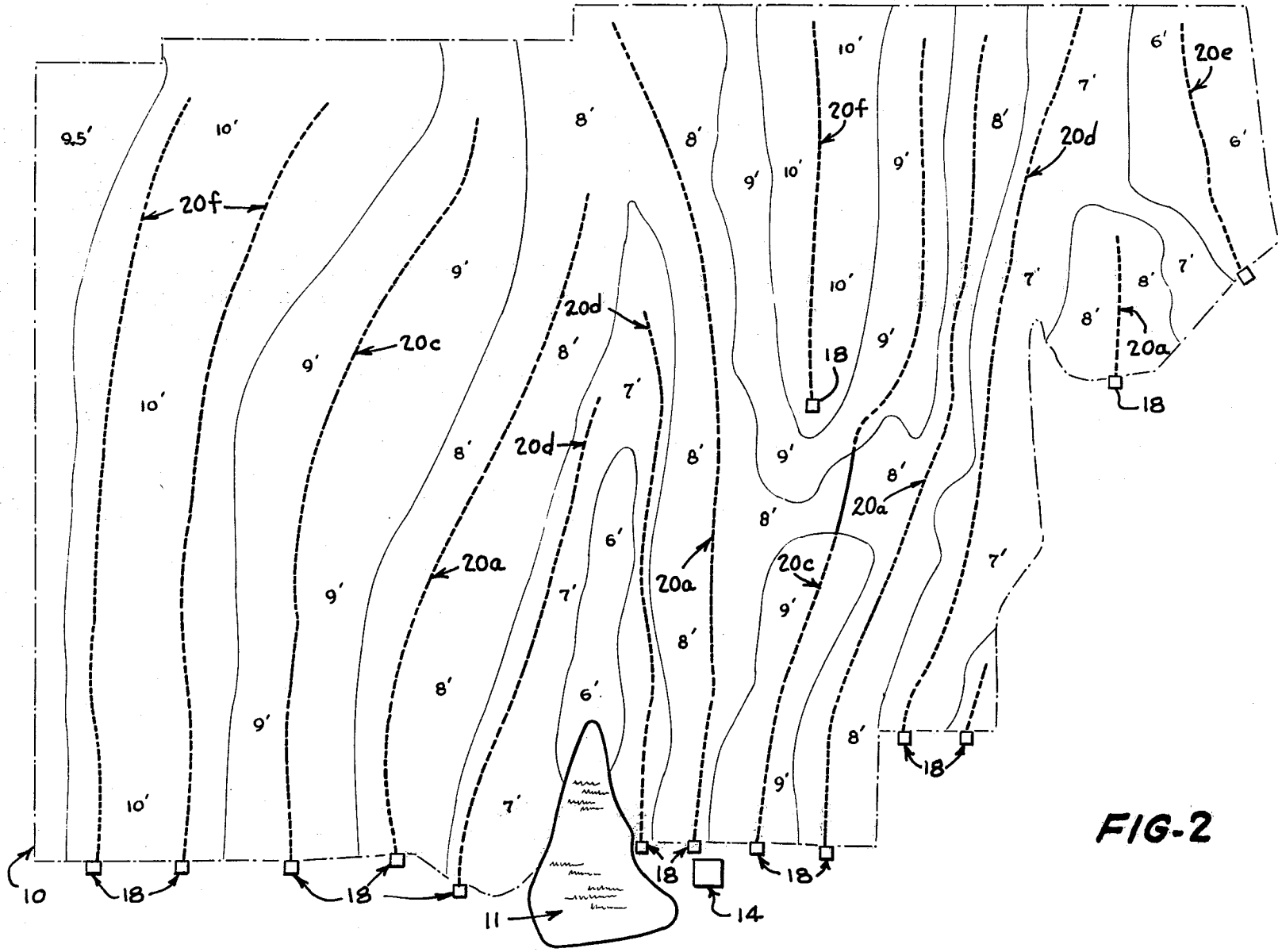
FIG. 2 is a typical layout or plan view of a cultivated field and subsurface irrigation and drainage system therefor embodying the present invention, with the subsurface two-way conduits indicated in broken lines.
Figure 5:
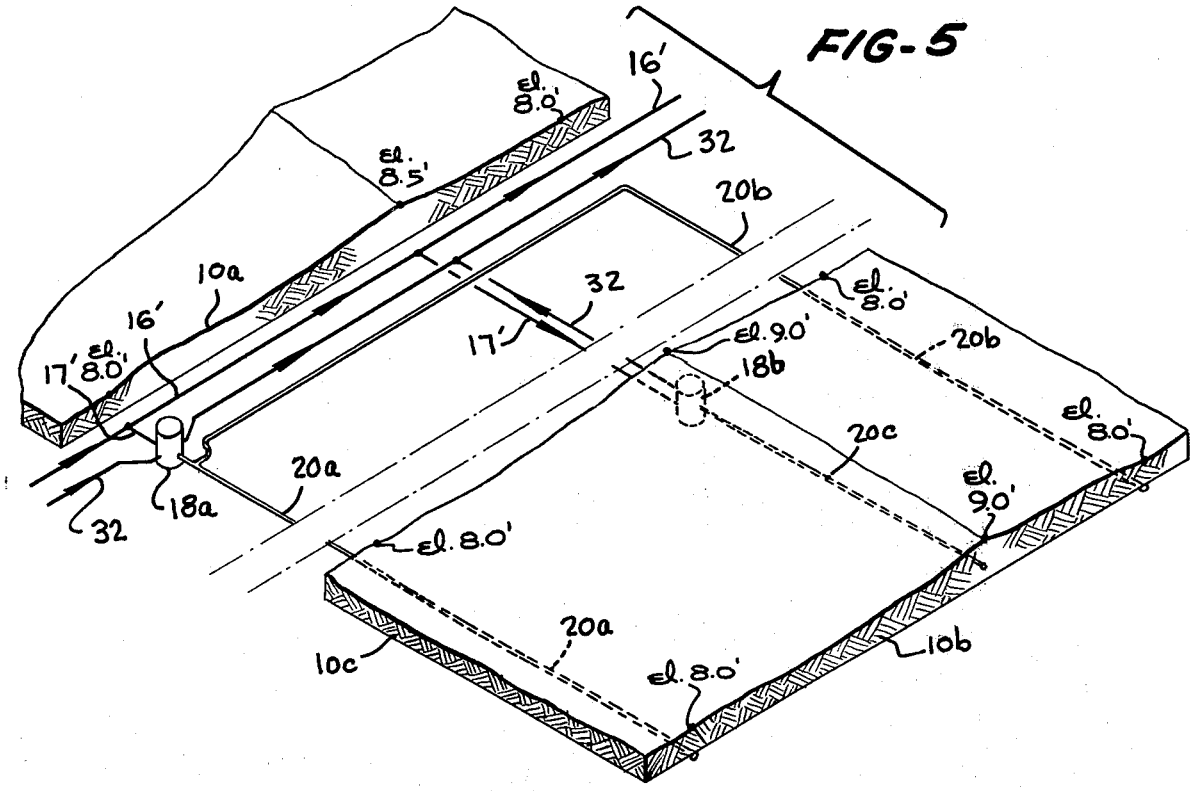
FIG. 5 is a somewhat diagrammatic elevation view, with parts broken away, illustrating the underground irrigation and drainage system of the present invention in a typical irregular terrain installation.

Referring to the drawings wherein like reference characters designate corresponding parts, throughout the several figures, and particularly to FIGS. 1, 2 and 5 illustrating the general nature of the subsurface irrigation and drainage system of the present invention, the system is designed to provide irrigating water supply to the cropland section or field under cultivation, whether it be a field of generally flat terrain or one of significant irregularity in terrain or soil type, to supply appropriate moisture for growing of the crops when the natural water table is below a particular level such that it does not supply adequate moisture for the growing of the crops, but which is also capable of draining water from the soil when the natural water table is above a predetermined level in subsurface distribution boxes at selected horizontal or elevation levels whereby the water being drained from the soil flows to the distribution boxes and maintains appropriate water levels in the distribution boxes, and any excess water is delivered by gravity flow to a collection or storage pond or facility. Referring to FIGS. 1, 2 and 5, the irrigation and drainage system of the present invention designed to serve a field indicated generally by the reference character 10, includes a collection or storage water supply facility, indicated generally by the reference character 11, such as a pond, lake or storage tank at a level below the field or cropland section 10 to be served, from which water is supplied by a pump 12 or other conventional means for transferring water, by a conduit or pipe system 13, to a head tank or main water source 14 disposed at an elevation above the field 10 to be served. The pump or other water transferring means 12, in accordance with conventional practice, may have an intake conduit 15 extending downwardly into the collection and storage water pond 11 to a subsurface level, and have a filtered or screened intake 15*a* at the lower intake end thereof for filtering contaminants from the water being drawn into the pump intake line 15. Water is supplied from the head tank 14 through a main water supply conduit system, indicated generally at 16, such as a main water supply manifold, having branch lines 17 respectively extending to each of a plurality of distribution boxes 18 disposed at appropriate locations along or through the field 10 to be served. These distribution boxes 18 will typically serve one or more branch sections of subsurface two-way perforated conduits arranged in branches or strings, each of which is laid horizontally at a chosen elevation level although not necessarily in a straight line. These branches or strings of subsurface two-way perforated conduits are indicated generally by the reference character 20 and may be relatively long pipe lines or conduit lines of one or more strings of subsurface two-way perforated conduits connected to a single distribution box or may be one string or branch of perforated two-way subsurface conduit, as, for example, is illustrated in FIG. 5.

The number of distribution boxes and the number of perforated two-way subsurface conduit strings or branches is dependent upon the topography of the field being served, as each line or string 20 of subsurface two-way conduit lies at a single horizontal level or elevation. While the conduit branches or strings may be formed of perforated conduit sections of any desired construction, the conventional corrugated, slotted black plastic conduit sections about 6 inches in diameter, commercially available in lengths of about 100 feet for drainage of low, wet cultivated field areas are particularly suitable for this use. Each single-elevation subsurface two-way perforated pipe line or conduit branch 20 is installed for example, by a trenching machine traveling along selected topographical contour lines for a chosen horizontal elevation or level across the field, each trench for an individual pipe line or conduit branch 20 being made along one chosen topographical contour line across the field, with the trench for each branch or line being dug to a first trial depth of about 36 inches to install the branch or line 20 at a burial depth of 36 inches from the surface. An example of a typical field portion is shown in FIG. 5 for illustrative purposes, where 8 foot, 8.5 foot and 9 foot ground elevations occur at the points shown, and where ground elevation contour lines for the 8 foot elevation level cross the field roughly parallel to each other approximately 80 feet apart and ground contour elevation lines for 8.5 foot elevation level and for 9.0 foot elevation level pass through the elevation points for those elevations illustrated in FIG. 5. In a first trial, one would normally choose, for example, to provide conduit branches or pipe lines 20 having lengths approximating the length of the field, at intervals of about 100 feet, depending on field topography, but in the illustration of FIG. 5, the spacing is closer due to the topography. In the illustrative example, a 36 inch deep trench is formed for the first two-way perforated conduit branch or line, indicated at 20*a*, along the 8.0 foot ground elevation contour line from one end or region 10*a* to the opposite end 10*b* of the field, near the edge 10*c*, and the sections of perforated conduit are connected end to end, or loosely fitted or abutted end to end, as desired, in the bottom of the trench to provide the desired first conduit branch or line 20*a*. Another 36 inch trench is formed, in the illustrated example, roughly parallel to and about 80 feet from the first conduit branch or line 20*a*, along the next ground elevation contour line for 8.0 foot elevation to form the perforated conduit branch or line 20*b*, and the perforated conduit sections making up the conduit branch or line 20*b* are laid in position and connected, fitted or butted together, and the trenches are then backfilled. Gravel or similar material may be provided in the lower part of the trenches as desired. It will be noted that these two-way perforated conduits branches or lines 20*a* and 20*b*, and the remaining two-way perforated conduit branches or lines 20, although they form elongated strings of piping or conduit section, are not laid in straight lines but follow the path necessary to maintain them exactly at the desired subsurface spacing below the chosen ground elevation so that each branch or string of perforated conduit is disposed horizontally at its predetermined elevation. Referring again to the illustrative example, a 36 inch trench is then made for a third two-way perforated conduit branch or string 20*c*, for example, for the 9.0 foot ground elevation contour line, by following the path of this contour line with a trenching machine traveling along the contour line across the field, and then installing the perforated conduit sections and backfilling the trench.

In the illustrated example, a distribution box for the two subsurface perforated conduit branches or lines 20*a* and 20*b* is provided, indicated at 18*a* in FIG. 5, since the two branches for the 8.0 foot ground elevation contour lines are sufficiently close to each together in this example to be served by the single distribution box, and another distribution box, indicated at 18*b*, is provided for the subsurface conduit branch or string 20*c* for the 9.0 foot ground elevation contour line.

FIG. 2 illustrates another more extensive field and possible arrangement of the subsurface conduit branches or strings 20 and distribution boxes 18, where, for example, the subsurface perforated conduit branches or lines for the 8 foot ground elevation contour lines (which of course are buried 36 inches below such 8 foot elevation) are also indicated by the reference characters 20*a*, conduit branches or strings for the 9 foot ground elevation contour lines are indicated at 20*c*, conduit branches or lines for the 7 foot ground elevation contour lines are indicated at 20*d*, a branch for the 6 foot ground contour line is indicated at 20*e*, and branches for the 10 foot ground contour line are indicated at 20*f*. The arrangement of distribution boxes 18 may be as illustrated in the typical example of FIG. 2, or, where conduit branches or strings for the same ground elevation are relatively close together, a single distribution box may serve both branches or strings.

Figure 4:
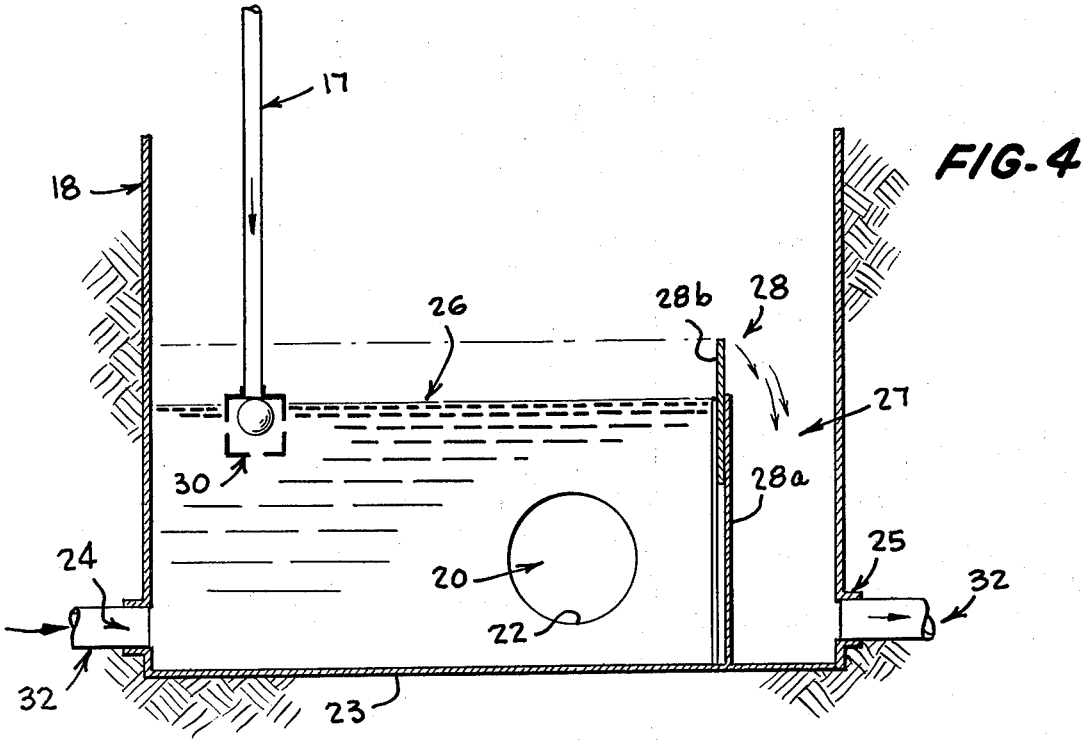
FIG. 4 is a fragmentary vertical section view through the lower portion of the distribution box and adjacent connecting portions of interconnecting excess water lines, taken along the line 4—4 of FIG. 3.

The distribution boxes have a port, indicated for example at 22 in FIG. 4, such as a flanged circular port, for connection to the associated two-way perforated conduit branch or string 20, located near the bottom 23 of the distribution box, and is also provided with an excess water connection port or ports, indicated at 24 and 25 in FIG. 4, located near the bottom 23 of the distribution box, to receive excess water from the preceding distribution box in the system, if there is a preceding distribution box, and to permit delivery of excess water to the next distribution box in the system. Means for providing a weir or dam formation is provided in each distribution box 18, to subdivide the distribution box into a main water chamber, indicated diagrammatically at 26 in FIGS. 4 and 7, and an excess water chamber, indicated at 27 in FIGS. 4 and 7. The weir or dam formation is preferably adjustable, and is indicated in FIG. 4 as a weir 28 formed of a fixed plate or wall **28*a* extending upwardly from and joined to the bottom 23 of the distribution box near the excess water outlet port 25, on which is slidably mounted an adjustable weir plate 28*b* which may be manually adjusted to form a dam or weir at a chosen level slightly above the normal water level in the main water chamber 26**.

The normal supply water to each distribution box is provided through the associated water supply branch pipe system 17 or 17' as indicated in FIGS. 4 and 7, with each associated main water supply branch 17 or 17' having a conventional level actuated valve, as indicated at 30 in FIGS. 4 and 7, which for example may be a float operated valve, to shut off the water supply through the associated supply branch pipe 17 or 17' when the desired normal water level, which is somewhat above the level of the subsurface perforated conduit port 22, occurs in the main water chamber 26 of the distribution box. The upper edge of the adjustable portion **28*b* of the weir 28 is preferably set slightly above the predetermined normal water level in the main water chamber 26 of the distribution box regulated by the level actuated valve 30, so that if excess water reaches the main water chamber 26 to raise its water level above the edge of the weir 28, excess water will flow over the weir into the weir chamber 27 and out through the excess water outlet 25 and the associated water conduit 32 to the excess water inlet port 24 of the next distribution box 18, and so on through the system. Such excess water may either enter the distribution box by flow of water from the soil through the slots or perforations in the subsurface perforated conduit branch or line 20 associated with the distribution box, as when rain has caused the natural water table to rise to the level of or above the predetermined normal water level in the main water chamber 26, or the excess water may be conveyed into the main water chamber 26 of a particular distribution box from the preceding distribution box in the system. As illustrated more clearly in FIG. 5, the distribution boxes are interconnected by excess water conduits 32 and, the main water supply to the distribution boxes from the head tank 14 may be by way of a subsurface water supply manifold indicated at 16' and subsurface main water supply branch lines 17'** extending from the manifold to each of the distribution boxes.

A slightly modified form of distribution box is illustrated in FIGS. 6 and 7, wherein the main water supply branch lines 17' are subsurface water supply lines entering the distribution box 18 through the side of the box and terminating in a float controlled level actuated valve assembly 30 as illustrated, and the weir formation 28 may be formed by the elbow pipe section **28*a*' coupled to conduit components indicated at 25' forming the excess water outlet conduit, passing through the side of the distribution box, with a threaded nipple, or short cylindrical pipe section, indicated at 28*b*', threaded into the elbow fitting 28*a*'** with the heigth of its upper open end determined by how far the nipple is threaded into the elbow section to establish the excess water overflow level for the weir. Obviously, nipples of different lengths may be chosen to adjust the heigth of the weir.

It will be apparent from the foregoing description that, if the natural water table for an irrigation and drainage system installation as described above is below the predetermined normal water level in the main water chamber 26 of the associated distribution box 18 for a particular ground elevation level, then water, or other elements such as liquid fertilizer or essential ingredients for the growth of crops, supplied from the head tank 14 and maintained at a predetermined level in the main water chamber 26 of the associated distribution box 18, will be discharged into the soil from the perforated conduit branch or string 20 served by the associated distribution box 18, and the level of water or other essential element will be maintained in the main chamber 26 of the distribution box by action of the level actuated valve 30 causing additional supply to the distribution box from the head tank 14. However, when the natural water table rises above the level of the weir or dam formation 28 in the associated distribution box 18, water inflow through the perforations of the conduit branch or string 20 from the soil into the main chamber 26 of the distribution box raises the water level in the distribution box above the level of the weir 28, causing excess water overflow into the weir chamber 27 and out through the outlet port 25 and excess water conduit 32 to the next distribution box, distributing the excess water through the system, until, ultimately, any surplus drains over the weir of the distribution box whose excess water outlet connects to the water collection or storage pond 11 to store such surplus in the pond for future use as needed. Thus the system operates to discharge the water or other essential elements into the soil when the natural water table in the field or cropland being served is below the maintained level in the distribution box for a particular subsurface perforated conduit branch or string, and serves to drain excess water from the soil, for example in case of heavy rain or flooding, when the natural water table rises above the chosen weir overflow level in the distribution box, the direction of flow within the subsurface perforated conduit branch or string being dependent on the heigth of the natural water table.

I claim:

1. An irrigation and drainage system for cultivated fields, croplands and the like for supplying and extracting water and similar liquids through a subsurface conduit network automatically responsive to the ground water table occurring above or below a predetermined subsurface reference level near the depth of the conduit network, comprising a plurality of elongated subsurface perforated conduit lines at spaced apart locations throughout the field each extending along a horizontal path at a uniform depth below ground along a predetermined reference ground elevation contour line for a chosen ground elevation for outflow of water from said conduit lines through said perforations into the adjacent subsoil when the ground water level is below said reference level and for inflow of ground water through the perforations into said conduit lines when the ground water level is above said reference level, a distribution box for the conduit lines for each different reference ground elevation contour line having a main water collection compartment for holding water at a selected water level therein communicating said water level with the contour lines served thereby for liquid egress and ingress to and from the contour lines, means for supplying water to the main water collection compartments of said distribution boxes from a water supply source located at a higher elevation than the conduit lines, weir means in each distribution box defining an overflow compartment for overflow of excess water from said main water collecting compartment exceeding said selected water level, and excess water conduit means interconnecting the overflow compartments of said distribution boxes with the water collecting compartments of other of said distribution boxes in a predetermined order.

2. An irrigation and drainage system as defined in claim 1, wherein the distribution boxes include automatic level regulating valve means responsive to the water level in the collection compartment thereof for regulating supply of water from the water supplying means to each collection compartment adequate to maintain said selected water level therein.

3. An irrigation and drainage system as defined in claim 1, wherein said means for supplying water includes supply pipes having discharge outlets in said collection compartments of said distribution boxes, and said distribution boxes include automatic level regulating float valves controlling said discharge outlets responsive to the water level in the collection compartments served thereby for automatically admitting water from the water supply source into the collection compartment adequate to maintain the selected water level.

4. An irrigation and drainage system as defined in claim 1, wherein said weir means includes a stationary weir portion extending along a part of the height of the collection compartment and a vertically adjustable upper weir portion having an overflow edge movable relative to the stationary weir portion for manual setting of the height of the overflow edge of the weir to establish said selected water level.

5. An irrigation and drainage system as defined in claim 2, wherein said weir means includes a stationary weir portion extending along a part of the height of the collection compartment and a vertically adjustable upper weir portion having an overflow edge movable relative to the stationary weir portion for manual setting of the height of the overflow edge of the weir to establish said selected water level.

6. An irrigation and drainage system as defined in claim 3, wherein said weir means includes a stationary weir portion extending along a part of the height of the collection compartment and a vertically adjustable upper weir portion having an overflow edge movable relative to the stationary weir portion for manual setting of the height of the overflow edge of the weir to establish said selected water level.

7. An irrigation and drainage system as defined in claim 1, for cultivated fields of uneven terrain having a range of different ground elevations, wherein said subsurface conduit lines include elongated subsurface conduit lines at a plurality of different elevation levels each formed of a series connected string of perforated pipe sections buried at a uniform depth below ground along respective reference ground elevation contour lines for a plurality of different ground elevations of predetermined vertical separation, and said system including at least one of said distribution boxes for the conduit line portions for each of said different elevation levels.

8. An irrigation and drainage system as defined in claim 2, for cultivated fields of uneven terrain having a range of different ground elevations, wherein said subsurface conduit lines include elongated subsurface conduit lines at a plurality of different elevation levels each formed of a series connected string of perforated pipe sections buried at a uniform depth below ground along respective reference ground elevation contour lines for a plurality of different ground elevations of predetermined vertical separation, and said system including at least one of said distribution boxes for the conduit line portions for each of said different elevation levels.

9. An irrigation and drainage system as defined in claim 3, for cultivation of fields of uneven terrain having a range of different ground elevations, wherein said subsurface conduit lines include elongated subsurface conduit lines at a plurality of different elevation levels each formed of a series connected string of perforated pipe sections buried at a uniform depth below ground along respective reference ground elevation contour lines for a plurality of different ground elevations of predetermined vertical separation, and said system including at least one of said distribution boxes for the conduit line for each of said different elevation levels.

10. An irrigation and drainage system as defined in claim 4, for cultivated fields of uneven terrain having a range of different ground elevations, wherein said subsurface conduit lines include elongated subsurface conduit lines at a plurality of different elevation levels each formed of a series connected string of perforated pipe sections buried at a uniform depth below ground along respective reference ground elevation contour lines for a plurality of different ground elevations of predetermined vertical separation, and said system including at least one of said distribution boxes for the conduit line for each of said different elevation levels.

11. An irrigation and drainage system as defined in claim 5, for cultivated fields of uneven terrain having a range of different ground elevations, wherein said subsurface conduit lines include elongated subsurface conduit lines at a plurality of different elevation levels each formed of a series connected string of perforated pipe sections buried at a uniform depth below ground along respective reference ground elevation contour lines for a plurality of different ground elevations of predetermined vertical separation, and said system including at least one of said distribution boxes for the conduit line for each of said different elevation levels.

12. An irrigation and drainage system as defined in claim 6, for cultivated fields of uneven terrain having a range of different ground elevations, wherein said subsurface conduit lines include elongated subsurface conduit lines at a plurality of different elevation levels each formed of a series connected string of perforated pipe sections buried at a uniform depth below ground along respective reference ground elevation contour lines for a plurality of different ground elevations of predetermined vertical separation, and said system including at least one of said distribution boxes for the conduit line for each of said different elevation levels.

13. An irrigation and drainage system as defined in claim 7, wherein said excess water conduit means interconnect respective pairs of said distribution boxes by connecting between the overflow compartment of a distribution box of the pair located at a higher one of said different elevation levels and the collection compartment of the other distribution box of the pair located at the next lower one of said different elevation levels.

14. An irrigation and drainage system as defined in claim 8, wherein said excess water conduit means interconnect respective pairs of said distribution boxes by connecting between the overflow compartment of a distribution box of the pair located at a higher one of said different elevation levels and the collection compartment of the other distribution box of the pair located at the next lower one of said different elevation levels.

15. An irrigation and drainage system as defined in claim 9, wherein said excess water conduit means interconnect respective pairs of said distribution boxes by connecting between the overflow compartment of a distribution box of the pair located at a higher one of said different elevation levels and the collection compartment of the other distribution box of the pair located at the next lower one of said different elevation levels.

16. An irrigation and drainage system as defined in claim 10, wherein said excess water conduit means interconnect respective pairs of said distribution boxes by connecting between the overflow compartment of a distribution box of the pair located at a higher one of said different elevation levels and the collection compartment of the other distribution box of the pair located at the next lower one of said different elevation levels.

17. An irrigation and drainage system as defined in claim 11, wherein said excess water conduit means interconnect respective pairs of said distribution boxes by connecting between the overflow compartment of a distribution box of the pair located at a higher one of said different elevation levels and the collection compartment of the other distribution box of the pair located at the next lower one of said different elevation levels.

18. An irrigation and drainage system as defined in claim 12, wherein said excess water conduit means interconnect respective pairs of said distribution boxes by connecting between the overflow compartment of a distribution box of the pair located at a higher one of said different elevation levels and the collection compartment of the other distribution box of the pair located at the next lower one of said different elevation levels.

19. An irrigation and drainage system as defined in claim 13, wherein said excess water conduit means interconnect respective pairs of said distribution boxes by connecting between the overflow compartment of a distribution box of the pair located at a higher one of said different elevation levels and the collection compartment of the other distribution box of the pair located at the next lower one of said different elevation levels and the overflow compartment of the distribution box at the lowest of said different elevation levels having an excess water outlet for discharging excess water to a lower collecting pool.

* * * * *

UNITED STATES PATENT AND TRADEMARK OFFICE

CERTIFICATE OF CORRECTION

PATENT NO. : 4,180,348

DATED : December 25, 1979

INVENTOR(S) : RICHARD H. TAYLOR

It is certified that error appears in the above-identified patent and that said Letters Patent are hereby corrected as shown below:

Column 7, lines 7 and 8, "contour" should read --conduit--

Signed and Sealed this

*Twenty-ninth* Day of *December 1981*

[SEAL]

*Attest:*

GERALD J. MOSSINGHOFF

*Attesting Officer*

*Commissioner of Patents and Trademarks*